US008590718B2

(12) United States Patent
Krome

(10) Patent No.: US 8,590,718 B2
(45) Date of Patent: Nov. 26, 2013

(54) COUPLING UNIT

(75) Inventor: Andreas Krome, Oberreichenbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 104 days.

(21) Appl. No.: 13/106,533

(22) Filed: May 12, 2011

(65) Prior Publication Data

US 2011/0240585 A1 Oct. 6, 2011

Related U.S. Application Data

(63) Continuation of application No. PCT/DE2009/001576, filed on Nov. 6, 2009.

(51) Int. Cl.
*B61G 1/32* (2006.01)

(52) U.S. Cl.
USPC ..... 213/75 R; 213/62 R

(58) Field of Classification Search
USPC ..... 213/75 R, 62 R
See application file for complete search history.

(56) References Cited

U.S. PATENT DOCUMENTS 5,172,819 A * 12/1992 Daugherety et al. ..... 213/75 R
5,271,511 A * 12/1993 Daugherty et al. ..... 213/75 R

FOREIGN PATENT DOCUMENTS

DE 693 15 632 T2 7/1998
DE 695 14 215 T2 7/2000
DE 10 2006 036 245 A1 2/2008

* cited by examiner

*Primary Examiner* — Zachary Kuhfuss
(74) *Attorney, Agent, or Firm* — Lucas & Mercanti, LLP

(57) ABSTRACT

A coupling unit for a semi-permanent connection of two wagons of a rail vehicle, which has a first housing and a second housing, which is pivotably and rotatably coupled to the first housing. A bearing outer ring with a hollow spherical inner bearing surface is fastened to the second housing and is guided in sliding fashion on a bearing inner ring with a spherical outer surface. The bearing inner ring is seated with an inner bore on a shaft fastened to the first housing. The shaft has, on a first end, one or two flattened portions and, on a second end, one or two second flattened portions. At least one clamping piece is provided which bears against one of the flattened portions and an opening region in the first housing, thereby preventing the shaft from rotating.

16 Claims, 4 Drawing Sheets

COUPLING UNIT

This application is a continuation of PCT/DE2009/001576 filed Nov. 6, 2009, which in turn claims the priority of DE 10 2008 057 055.9 filed Nov. 13, 2008, the priority of both applications is hereby claimed and both applications are incorporated by reference herein.

FIELD OF THE INVENTION

The invention relates to a coupling unit, in particular for the semi-permanent connection of two freight cars of a rail vehicle.

BACKGROUND OF THE INVENTION

In rail vehicles, adjacent freight cars which are located together on a truck (for example Jacobs truck) are coupled by means of semi-permanent connections. Said connections are also referred to as "tight couplings." Vehicles having connections of this type are also referred to as "tight-coupled units." For the most part, only two vehicles are coupled to each other, but sometimes there are also more.

The object of said tight coupling is to transmit the tensile and compressive forces in the longitudinal direction of the vehicle from one freight car to the other upon acceleration and braking. Furthermore, said tight coupling is intended to transmit the transverse forces during curve travel and due to weight. The coupling is intended to ensure mobility about all three axes in space. During curve travel, the main movement angles occur about the vertical z axis. If depressions or bumps are crossed, tilting angles about a horizontally extending y axis and rolling angles about an x axis extending in the longitudinal direction of the train also occur and should be compensated for by the coupling. Furthermore, a tight coupling should not have any linear degrees of freedom in order to avoid jolting during changes of load.

There is a number of known solutions for the above-mentioned application. Said solutions are based predominantly on the fact that a radial swivel bearing having a horizontal bearing axis forms the central element of the articulated connection. The swivel bearing has the required rotatory angular movements because of suitable geometry in all three pivot axes. For this purpose, the swivel bearing is fixed via the outer ring thereof in a coupling housing. The housing constitutes a swivel head and is suitably connected in the longitudinal direction of the vehicle to the vehicle frame of one of the freight car ends to be connected. A welded joint is usually used for this purpose. The swivel bearing is fixed via the inner ring thereof to a stem or a shaft and the latter is fixed in turn in a housing. In various solutions of the prior art, the stem and inner ring are designed as a single part. The housing in turn is likewise connected in the longitudinal direction of the vehicle to the end of the second freight car to be connected. A welded joint is customarily also used for this. The housing is frequently shaped at the bottom in such a manner that it can be directly supported on the center plate of the truck. The required articulated connection is thereby formed. Said solutions from the prior art have swivel bearings requiring maintenance (lubrication with grease/oil) or swivel bearings which are maintenance-free (sliding layers between the outer and inner rings). Furthermore, solutions requiring maintenance and having other bearing solutions are known, but said solutions do not meet the ever-increasing service life requirements.

However, these known solutions from the prior art all have disadvantages. For example, the coordination of tolerances of the stem, housing, supporting disks and bearing width is difficult with regard to a play-free stem connection. Furthermore, the assembly/removal in the event of deformation of the stem is difficult. The stem seat in the housing or the inner ring seat on the stem frequently becomes corroded. The possibility of maintaining the known tight couplings of this type is therefore inadequate. Furthermore, the stem is insufficiently fixed in the housing. Constructional forms which are not sealed cause a high outlay on maintenance due to the required regreasing.

A further known type of articulated coupling unit for the semi-permanent connection of railroad freight cars is known from DE 691 08 977 T2. However, sealing of the bearing elements is not provided, and this restricts the use. In this coupling unit, the use of a wedge-shaped clamping part in order to fix the receiving stem of the inner bearing part on the housing is disadvantageous with regard to secure fastening and freedom from play, in particular in the event of shaking.

SUMMARY OF THE INVENTION

It is therefore an object of the present invention to provide a coupling unit, in particular for the semi-permanent connection of two freight cars of a rail vehicle, which minimizes the disadvantages of the prior art. Furthermore, the coupling unit is intended to ensure sufficient rigidity at as low a component weight as possible. In addition, simple separation and connection of the coupling unit, even after many years of use, is intended to be possible. For the bearing elements, the use of replaceable wearing parts is intended to be possible. The coupling unit is intended furthermore to be of simple construction, and to be able to be produced cost-effectively and fitted rapidly. Sealing of the bearing elements in the coupling unit is intended to be possible.

The object is achieved according to the invention by a coupling unit, in particular for the semi-permanent connection of two freight cars of a rail vehicle, with a first housing for fastening to a first railroad freight car and with a second housing, which is coupled pivotably and rotatably to the first housing and is intended for fastening to a second railroad freight car. A bearing outer ring, which has a hollow spherical inner bearing surface is fastened to the second housing and is guided in a sliding manner on a bearing inner ring that has a spherical outer surface, and the bearing inner ring sits with an inner bore on a shaft, which is fastened to the first housing. A first end of the shaft has one or two flattened portions running in the axial direction of the shaft and a second end has one or two second flattened portions running in the axial direction of the shaft. At least one clamping piece is provided which bears against one of the flattened portions and an opening region in the first housing and thereby secures the shaft against rotation.

Preferred further refinements of the invention are specified in the dependent claims.

According to one embodiment, the clamping piece is of cuboidal, wedge-shaped or cylindrical design. According to another embodiment, the clamping piece consists of at least two clamping piece parts.

According to another embodiment, the flattened portions at the first shaft end are oriented parallel to each other and/or the flattened portions at the second shaft end are oriented parallel to each other. According to another embodiment, the first flattened portions and/or the second flattened portions are arranged at differing close distances from the axis of symmetry of the shaft.

According to another embodiment, the bearing inner ring and the shaft are of integral design as a single component.

According to another embodiment, a first supporting ring is arranged on the shaft adjacent to the bearing inner ring and the first housing, and/or a second supporting ring is arranged adjacent to the bearing inner ring and the first housing. According to another embodiment, the supporting rings and the bearing inner ring are designed as a single component.

According to another embodiment, a first sealing bellows and/or a second sealing bellows are/is arranged running around the shaft, the first sealing bellows bearing in a sealing manner against the second housing and the bearing inner ring and/or the first supporting ring, and the second sealing bellows bearing in a sealing manner against the second housing and the bearing inner ring and/or the second supporting ring. According to another embodiment, a first tensioning element is arranged on the first sealing bellows in a manner running around the shaft, the tensioning element pressing the first sealing bellows against the first sealing ring, and/or a second tensioning element is arranged on the second sealing bellows in a manner running around the shaft, the tensioning element pressing the second sealing bellows against the second supporting ring.

According to another embodiment, an extension for support on a center plate is formed on the first housing.

According to another embodiment, sliding material is arranged between the bearing inner ring and the bearing outer ring.

According to another embodiment, the first housing is provided with an opening which has a central, at least partially cylindrical opening region for receiving the shaft, and an inner opening region for receiving the clamping piece. According to another embodiment, the inner opening region is of at least partially cuboidal design. According to another embodiment, the inner cylindrical opening region has a clearance.

According to another embodiment, the shaft has at least two axial bores at the first end and/or second end.

According to another embodiment, the shaft projects beyond the housing, and therefore at least one of the pairs of flattened portions (13*a*, 13*b*, or 14*a*, 14*b*) is partially arranged outside the housing.

BRIEF DESCRIPTION OF THE DRAWINGS

The invention is explained in more detail below using exemplary embodiments and with reference to the attached drawings. The same reference numbers denote components which are in each case identical in the figures, unless otherwise stated.

In the figures.

DETAILED DESCRIPTION OF THE INVENTION

Figure 1A:
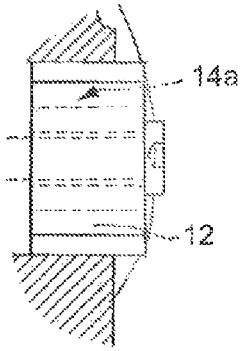
FIG. 1*a* shows a detail of a coupling element according to a further embodiment of the present invention.
Figure 1:
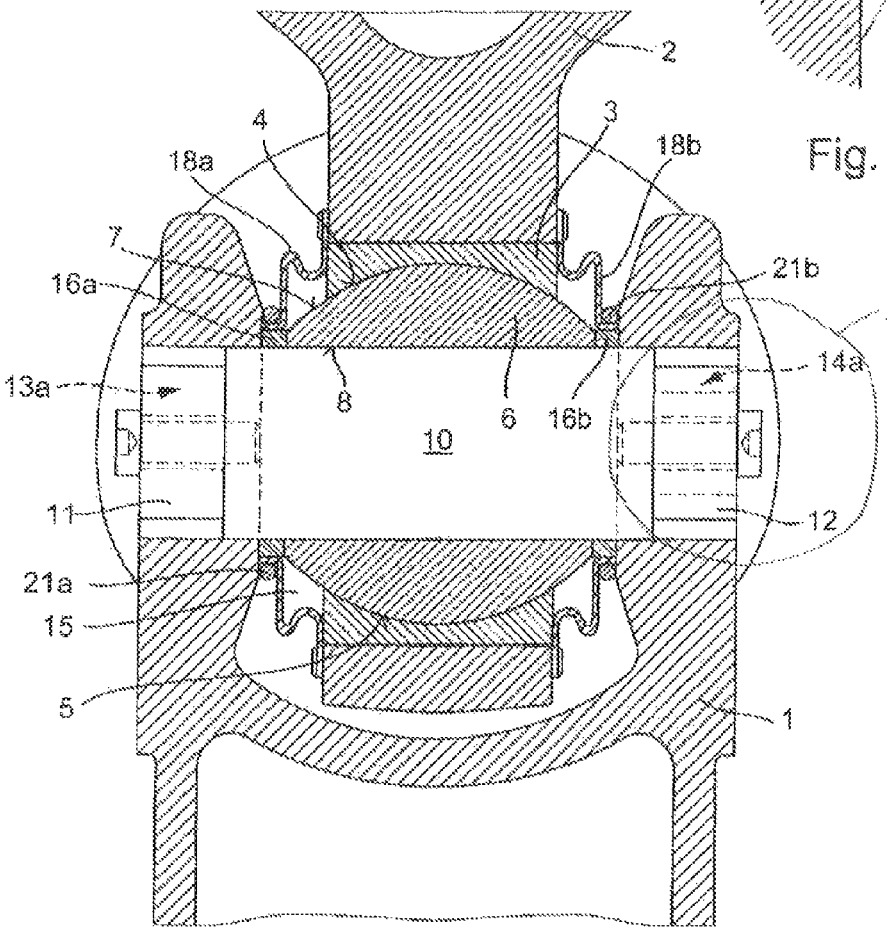
FIG. 1 shows a schematic sectional illustration in the form of a front view of a coupling element according to the invention in accordance with a first exemplary embodiment.

FIG. 1 shows a schematic sectional illustration in the form of a front view of a coupling unit according to the invention in accordance with a first exemplary embodiment. The coupling unit has a first housing 1 (illustrated by hatching) for fastening to a first railroad freight car (not illustrated) and a second housing 2 (likewise illustrated by hatching) which is coupled pivotably and rotatably to the first housing 1 and is intended for fastening to a second railroad freight car (not illustrated). A bearing outer ring 3 having a hollow spherical inner bearing surface 4 is mounted in the second housing 2. A bearing inner ring 6 having a spherical outer surface 7 is depicted on the inside of the bearing outer ring 3. The bearing outer ring 3 is guided in a sliding manner on the bearing inner ring 6. The bearing inner ring 6 has an inner bore 8 through which a shaft 10 extends. The shaft 10 has shaft ends 11, 12 which are fastened in the material of the first housing 1. A radial swivel bearing 15 having a substantially horizontal orientation of the bearing axis is formed by the bearing inner ring 6 and the bearing outer ring 3. The bearing outer ring 3 is fixed in the second housing 2. In this exemplary embodiment, the shaft 10 and the bearing inner ring 6 are realized in the form of two components. According to the invention, the shaft 10 and inner ring 6 may also be designed as a single component. In this embodiment, the radial swivel bearing 15 is provided with sliding material 5, for example sliding fabric or a sliding coating, for example made of bronze or Teflon, on the inner bearing surface 4 of the bearing outer ring 3, for freedom from maintenance. Lubrication with grease between the outer ring 3 and inner ring 6 is also provided. Supporting rings 16*a*, 16*b* are arranged on the shaft 10 on both sides next to the bearing inner ring 6, the supporting rings fixing and positioning the inner ring 6 in relation to the first housing 1. According to the invention, said supporting rings 16*a*, 16*b* and the bearing inner ring 6 can also be designed in the form of a single component. The supporting rings 16*a*, 16*b* then form lateral flanges of the bearing inner ring 6. Expansion bellows 18*a*, 18*b* extend from the second housing 2 to the respective supporting ring 16*a* and 16*b* and as far as the first housing 1. The expansion bellows 18*a*, 15*b* can be used to prevent liquid, dust or dirt from penetrating the radial swivel bearing 15. This serves to increase the service life of the radial swivel bearing 15 and to extend the maintenance intervals. The expansion bellows 18*a*, 18*b* are designed in such a manner that they slip through at least one fastening point on the outside/inside if the pivoting angles are too large, or elastically permit deformation. In the present exemplary embodiment, tensioning elements 21*a*, 24*b* are mounted for this purpose around the expansion bellows 18*a*, 18*b*, the tensioning elements pressing the expansion bellows 18*a*, 18*b* against the supporting rings 16*a* and 16*b*. According to the invention, the tensioning elements 21*a*, 21*b* can be designed in the form of wire rings, worm springs, hose clips or the like. The tensioning elements 21*a*, 21*b* can be produced from steel, plastic or from other suitable permanently elastic materials. The effect achieved by said fixing is that the tightness is ensured for a long time and the prestress does not become too low due to plastic deformation of the actual expansion bellows material in order to ensure the tightness.

Figure 2:
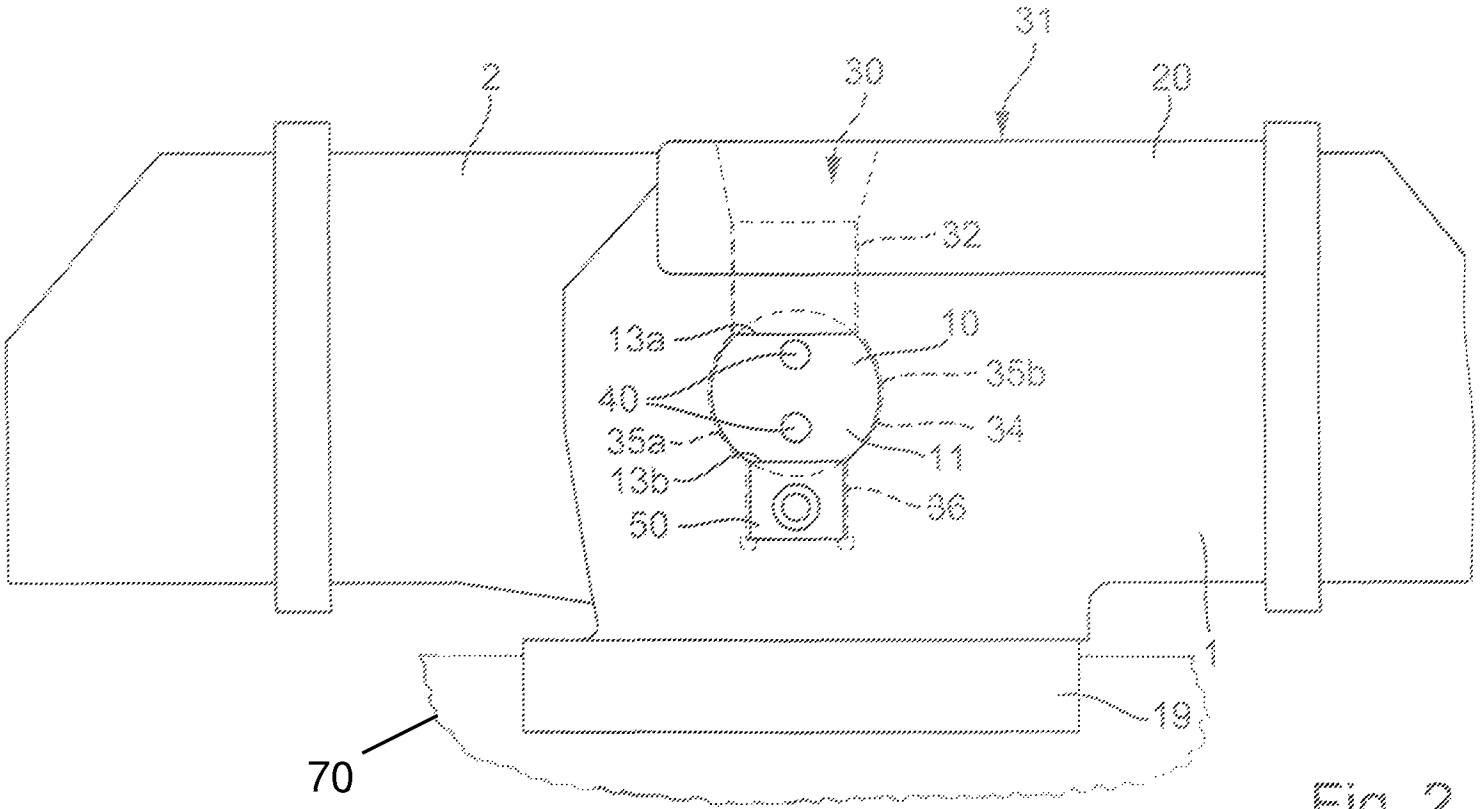
FIG. 2 shows a schematic illustration of a side view of a coupling unit according to the invention in accordance with a second exemplary embodiment.

FIG. 2 shows a schematic illustration of a side view of a coupling unit according to the invention in accordance with a second exemplary embodiment. The coupling unit from FIG. 2 is constructed substantially in the manner of that from FIG. 1. The first housing 1 has an extension 19 which extends in a substantially planar manner. It is possible by means of said extension 19 for the first housing 1 to be supported on a center plate (not illustrated). The extension 19 is advantageously designed here in such a manner that the first housing 1 can be supported directly on the center plate. The first housing has lateral stiffening means 20, here in the form of stiffening ribs 20. The stiffening ribs 20 have the task of preventing the upwardly open first housing 1 from gaping open under high tensile loads. The first end 11 of the shaft 10 has axially extending and facing flattened portions 13*a*, 13*b* and the second end 12 thereof correspondingly has—not illustrated here—axially extending and facing flattened portions 14*a*, 14*b*. By means of said flattened portions 13*a*, 13*b*, 14*a*, 14*b*, the distance between the facing pairs of flattened portions 13*a*, 13*b* and 14*a*, 14*b* is smaller than the outside diameter of the shaft 10 in the cylindrical, unreduced region. In this embodiment the facing flattened portions 13*a*, 13*b* are of asymmetrical design. The same applies for the flattened portions 14*a*, 14*b*. That is to say, the flattened portion 13*a* which is illustrated further up in the figure is located closer to the center axis of the shaft 10 than the flattened portion 13*b* and therefore has a greater width. However, the flattened portions 13*a*, 13*b* may also be of symmetrical design. In the case of the asymmetrical design, which is present in this embodiment, of the flattened portions 13*a*, 13*b* and 14*a*, 14*b* on the shaft 10, the contact surface between the shaft 10 and the first housing 1 differs in size in the longitudinal direction of the vehicle in the blocked state of the shaft 10. In practice, the coupling unit has to be able to transmit higher compressive forces than tensile forces in the longitudinal direction of the vehicle. By means of suitable orientation of the differently sized contact surfaces (the larger surface in the direction of compression), the load-bearing capacity of the contact between the shaft/first housing 1 can be matched to said different requirements. By means of the differently sized contact surfaces, there is also greater load-bearing capacity downward in the vertical direction than upward. The first housing 1 has an opening 30 through which the shaft 10 can be inserted into the first housing 1 on an insertion side 31 of the first housing 1. The opening 30 essentially has three subregions 32, 34, 36 for each shaft end 11, 12. The first opening region 32 starting from the insertion side 31 is of substantially cuboidal design and opens upward in a funnel-shaped manner, which facilitates insertion during installation of the shaft 10. Said first opening region 32 emerges into a substantially cylindrical central opening region 34. The central opening region 34 merges into a third inner opening region 36 which is of partially cuboidal design. The opening width of the first opening region is scarcely larger than the shaft width in the region of the flattened portions 13*a*, 13*b*, 14*a*, 14*b*, i.e. the distance of the flattened portions 13*a*, 13*b* and 14*a*, 14*b* from each other. The diameter of the cylindrical central opening region 34 approximately corresponds to the diameter of the shaft 10. In order to install the shaft 10 into the first housing 1, said shaft is oriented for insertion into the first opening region 32 in such a manner that the flattened portions 13*a*, 13*b*, 14*a*, 14*b* are oriented parallel to the insertion direction or to the side surfaces of the first cuboidal opening region 32. The shaft 10 is then lowered into the opening 30 until it reaches the end of the cylindrical central opening region 34. At this point, the shaft is rotated through 90°. As a result, the cylindrical surfaces of the shaft and those of the central opening region 34 come into contact in the region of contact zones 35*a*, 35*b*. After this rotation, the shaft 10 is fixed in the longitudinal direction of the vehicle and also vertically upward and downward. The cylindrical contact zones 35*a*, 35*b* on the outer circumference of the shaft 10 between the flattened portions 13*a*, 13*b* and 14*a*, 14*b* take on the function here of transmitting the tensile and compressive forces from the traveling mode, of downwardly supporting the weight of the supported freight car and of absorbing forces rising upward from the traveling dynamics or from lifting operations in, for example, maintenance/accident situations. In this exemplary embodiment, two axial bores 40 are in each case provided in the shaft 10 on the end sides of the shaft ends 11, 12. By means of suitable tools which engage in said bores 40, rotation of the shaft 10 is simplified. According to the invention, the shaft 10 may also be designed to be longer such that it projects beyond the housing 1, as shown in FIG. 1*a*. Tools, for example wrenches, can then be brought into engagement on the flattened portions 13*a*, 13*b* and 14*a*, 14*b* to rotate the shaft 10. A clamping piece 50 is fitted into the inner opening region 36 at each of the shaft ends 11, 12. Once fitted, the clamping piece 50 presses against one of the flattened portions 13*a*, 13*b* or 14*a*, 14*b* of the shaft 5 and the first housing 1 and thereby prevents rotation of the shaft 10. The clamping piece 50 can be secured against falling out, for example by means of screwing or other suitable measures.

In the coupling unit according to the invention, the shaft 10 with the flattened portions 13*a*, 13*b* can be produced cost-effectively. The cylindrical shaft 10 has a high load-bearing capacity compared to the solutions from the prior art, since the flattened portions 13*a*, 13*b* are arranged perpendicular to the main loading zone and are also relatively small. The housing parts 1, 2 can be produced in a simple manner since few surfaces have to be machined as functional surfaces. The installation, in particular through the upwardly open first housing 1, and the fastening by means of clamping are simple. A further advantage resides in the sealing. The actual functional surfaces of the bearing 15 are protected from impurities and moisture. As a result, there is less wear on the sliding layer, and longer maintenance intervals are possible, in particular for bearings requiring maintenance. The coupling unit according to the invention provides better protection of the inner parts against corrosion, or little or no substantial protection of said parts against corrosion is required, since said parts are arranged in a well-protected manner. The coupling unit according to the invention is based on the basic construction "radial swivel bearing having a horizontal bearing axis". This configuration achieves the optimum with regard to bearing/housing rigidity, overall mass, force absorption capacity, distribution of pressure, movement angle, bearing service life and required fitting space.

Figure 3:
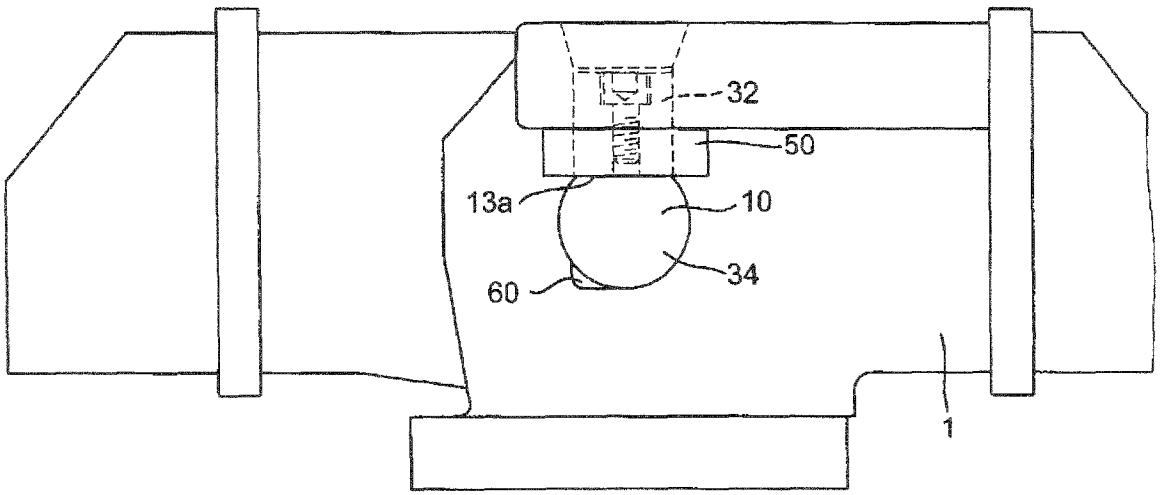
FIG. 3 shows a schematic sectional illustration of a coupling unit according to the invention in accordance with a third exemplary embodiment.

FIG. 3 shows a schematic sectional illustration of a coupling unit according to the invention in accordance with a third exemplary embodiment. The coupling unit substantially corresponds to those from FIG. 1 and FIG. 2. The clamping piece 50 is mounted here between the upper flattened portion 13*a* of the shaft and the lateral stiffening means 20 of the housing. Since said clamping piece serves merely for the rotative fixing of the shaft 10, it is not integrated into the actual force flux between shaft 10 and first housing 1 for transmitting the operating loads. This constitutes a crucial difference over existing solutions.

The basic principle of the invention is that a flattened cylindrical shaft 10 is inserted into a substantially cylindrical central opening region 34 which is open radially on one side. In this case, the shaft 10 is flattened to such a severe extent that it just fits through the radial first opening region 32 on one side adjacent to the central opening region 34. By rotation of the shaft 10, the remaining cylindrical contour of the shaft 10 closes the cylindrical central opening region 34, which is open radially on one side, as a result of which the shaft 10 is fixed. For this purpose, the shaft 10 is narrower in the region of the flattened portion 13*a* than its nominal outside diameter. This can be achieved by two flattened portions, but also by a single flattened portion. The flattened portion 13*a* is used at the same time as a bearing surface for a clamping piece 50, this preventing rotation of the shaft 10. As a result, the shaft 10 is locked, in the event of a flattened portion 13*a* only on one side, one side of the cylindrical bore 36*a* in the first housing can obtain a clearance 60 which permits the shaft to be inserted with subsequent rotation. The provision of only one flattened portion 13*a* makes it possible to realize the shaft 10 of the clamping unit according to the invention more cost-effectively, since fewer flattened portions have to be produced.

Figure 4:
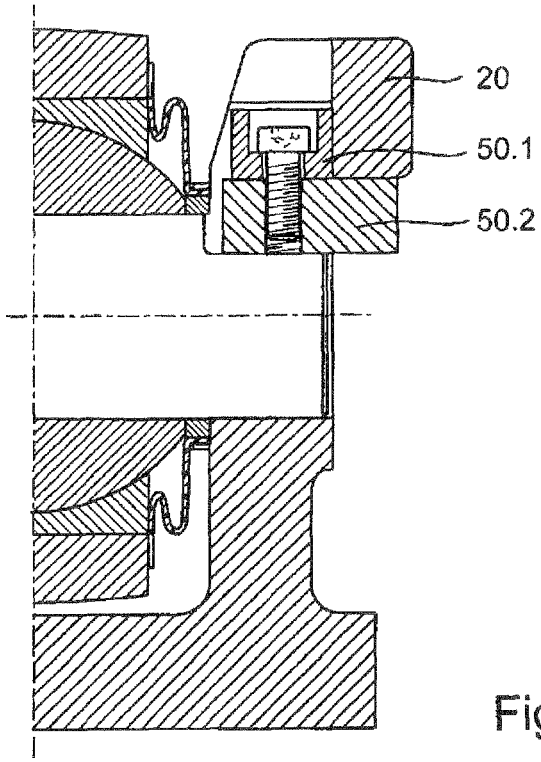
FIG. 4 shows a schematic sectional illustration of part of a coupling unit according to the invention in accordance with a fourth exemplary embodiment.

FIG. 4 shows a schematic sectional illustration of part of a coupling unit according to the invention in accordance with a fourth exemplary embodiment. The clamping piece 50 here is in multipart form consisting of a first clamping piece part 50.1 and a second clamping piece part 50.2 and is arranged on a stiffening means 20 of the housing.

Although the present invention has been described here with reference to preferred exemplary embodiments, it is not restricted thereto but rather can be modified in diverse ways.

LIST OF REFERENCE NUMBERS

1 First Housing
2 Second Housing
3 Bearing Outer Ring
4 Inner Bearing Surface
5 Sliding Material
6 Bearing Inner Ring
7 Outer Surface
8 Inner Bore
10 Shaft/Stem
11 First End
12 Second End
13*a*, 13*b* Flattened Portions at the First Shaft End
14*a*, 14*b* Flattened Portions at the Second Shaft End
15 Radial Swivel Bearing
16*a*, 16*b* Supporting Rings
18*a*, 18*b* Expansion Bellows
19 Extension
20 Stiffening Rib
21*a*, 21*b* Tensioning Elements
30 Opening
31 Insertion Side
32 First Opening Region
34 Central Opening Region
35*a*, 35*b* Contact Zones
36 Inner Opening Region
40 Axial Bore
50 Clamping Piece
50.1 First Clamping Piece Part
50.2 Second Clamping Piece Part
60 Clearance

The invention claimed is:

1. A coupling unit for the semi-permanent connection of two freight cars of a rail vehicle, comprising:

a first housing, which has an opening region, for fastening to a first railroad freight car;

a second housing coupled pivotably and rotatably to the first housing and fastenable to a second railroad freight car;

a bearing outer ring having a hollow spherical inner bearing surface fastened to the second housing;

a bearing inner ring having a spherical outer surface and an inner bore, the bearing outer ring guided in a sliding manner on the bearing inner ring;

a shaft fastened to the first housing, the shaft extending through the inner bore of the inner ring, the shaft having a first end with one or two first flattened portions running in an axial direction of the shaft and a second end having one or two second flattened portions running in the axial direction of the shaft; and at least one clamping piece bearing against one of the flattened portions and positioned in the opening region in the first housing, thereby securing the shaft against rotation, wherein the clamping piece is arranged so that the clamping piece only rotatively fixes the shaft relative to the first housing, and is outside of a force flux for transmitting operating loads between the shaft and the first housing.

2. The coupling unit as claimed in claim 1, wherein the clamping piece is cuboidal, wedge-shaped or cylindrical.

3. The coupling unit as claimed in claim 1, wherein the clamping piece has at least two clamping piece parts.

4. The coupling unit as claimed in claim 1, wherein the flattened portions at the first end of the shaft are oriented parallel to each other and/or the flattened portions at the second end of the shaft are oriented parallel to each other.

5. The coupling unit as claimed in claim 1, wherein the first flattened portions and/or the second flattened portions are arranged at differing close distances from an axis of symmetry of the shaft.

6. The coupling unit as claimed in claim 1, wherein the bearing inner ring and the shaft are of integral design as a single component.

7. The coupling unit as claimed in claim 1, further comprising a first supporting ring arranged on the shaft adjacent to the bearing inner ring and the first housing, and/or a second supporting ring is arranged adjacent to the bearing inner ring and the first housing.

8. The coupling unit as claimed in claim 7, wherein the first supporting ring, the second supporting ring and the bearing inner ring are a single component.

9. The coupling unit as claimed in claim 7, further comprising a first sealing bellows and/or a second sealing bellows running around the shaft, the first sealing bellows bearing in a sealing manner against the second housing and the bearing inner ring and/or the first supporting ring, and the second sealing bellows bearing in a sealing manner against the second housing and the bearing inner ring and/or the second supporting ring.

10. The coupling unit as claimed in claim 1, further comprising an extension formed on the first housing which supports a center plate.

11. The coupling unit as claimed in claim 1, further comprising sliding material arranged between the bearing inner ring and the bearing outer ring.

12. The coupling unit as claimed in claim 1, wherein the first housing has an opening which has a central, at least partially cylindrical opening region for receiving the shaft, and an inner opening region for receiving the clamping piece.

13. The coupling unit as claimed in claim 12, wherein the inner cylindrical opening region has a clearance.

14. The coupling unit as claimed in claim 1, wherein the shaft has at least two axial bores at the first end and/or the second end.

15. The coupling unit as claimed in claim 1, wherein the shaft projects beyond the first housing, and at least one pair of the first flattened portions or the second flattened portions is partially arranged outside the first housing.

16. The coupling unit as claimed in claim 1, wherein the first housing has an opening with an opening region having contact zones, the shaft being received in the opening region and the contact zones transmitting all of the operating loads between the shaft and the first housing.

* * * * *